US005144342A

United States Patent [19]

Kubota

[11] Patent Number: 5,144,342

[45] Date of Patent: Sep. 1, 1992

[54] HEAD FOR INK-JET PRINTER

[75] Inventor: Hiroshi Kubota, Yamato-Takada, Japan

[73] Assignee: Sharp Kabushiki Kaisha, Osaka, Japan

[21] Appl. No.: 798,341

[22] Filed: Nov. 20, 1991

Related U.S. Application Data

[63] Continuation of Ser. No. 533,579, Jun. 5, 1990, abandoned.

[30] Foreign Application Priority Data

Jun. 9, 1989 [JP] Japan ..... 1-147089

[51] Int. Cl.[5] ..... B41J 2/045

[52] U.S. Cl. ..... 346/140 R

[58] Field of Search ..... 346/140 R

[56] References Cited

U.S. PATENT DOCUMENTS 4,367,478 1/1983 Larsson ..... 346/140 PD
4,819,014 4/1989 Yasuhara et al. ..... 346/140 PD
4,937,597 6/1990 Yasuhara et al. ..... 346/140 R
4,962,391 10/1990 Kitahara et al. ..... 346/140 PD

FOREIGN PATENT DOCUMENTS 63-92745 6/1988 Japan .

*Primary Examiner*—Benjamin R. Fuller
*Assistant Examiner*—Alrick Bobb
*Attorney, Agent, or Firm*—David G. Conlin; Robert M. Asher

[57] ABSTRACT

A head for an ink-jet printer includes an elastic plate, a wall member defining an ink chamber together with the elastic plate, a nozzle provided in the wall member and communicated with the chamber, and a piezoelectric element. The piezoelectric element is shaped in a plate, has a side face, which defines a thickness of the piezoelectric element, and is disposed such that the side face faces the elastic plate. The piezoelectric element presses the elastic plate at the side face by an expansion due to a piezoelectric effect in a direction toward the side face. The head further includes electrodes attached to the piezoelectric element for applying an electric voltage across the piezoelectric element so as to cause the piezoelectric effect.

10 Claims, 2 Drawing Sheets

HEAD FOR INK-JET PRINTER

This is a continuation of copending application Ser. No. 07/533,579 filed on Jun 19, 1990, now abandoned.

BACKGROUND OF THE INVENTION

1. Field of the Invention

This invention relates to a head for an ink-jet printer.

2. Description of the Related Art

Ink-jet printers are known as one kind of terminal equipment for computers. Heads for on-demand type ink-jet printers which utilize piezoelectric elements as actuators are classified into two major types, namely into bimorph-type heads and piston-type heads.

FIG. 1 is a schematic cross-sectional view showing a bimorph-type head. The illustrated bimorph-type head has an ink chamber defined by stainless sheets 2 which are combined in layers, and a piezoelectric element 3. The piezoelectric element 3 has two electrode sheets 8*a* and 8*b* for application of voltage, and they are disposed to extend across the opposite flat faces of the piezoelectric element 3. An ink chamber 4 and a nozzle 5 communicate with each other through an ink supply chamber 6, and the ink supply chamber 6 also communicates with an ink supply channel 7. In general form, a plurality of heads each having the above-described arrangement are disposed in opposition to the surface of a recording sheet and a plurality of the nozzles 5 are therefore arranged in opposition to the same surface.

The operation of the bimorph-type head will be explained below. When a voltage is applied across the electrodes 8*a* and 8*b* of the piezoelectric element 3, the piezoelectric element 3 contracts in the transverse direction indicated by arrows 9 shown parallel to the respective electrodes 8*a* and 8*b* to deform one of the stainless sheets 2 which is attached directly to the piezoelectric element 3, thereby expelling a jet of ink droplets from the nozzle 5. Each of the heads is made to independently perform the above-described operation, thereby enabling information to be recorded.

The piston-type head will be explained below. FIG. 2 is a schematic cross-sectional view showing a particular piston-type head. The illustrated piston-type head has an ink chamber 11, a piston 12 and a piezoelectric element 13. The piezoelectric element 13 has two electrode sheets 17*a* and 17*b* for application of voltage, and they are disposed to extend across the opposite flat faces of the piezoelectric element 13. The ink chamber 11 includes a cylinder 14 in which ink is accommodated. The cylinder 14 is hermetically sealed by sealing member 18, and communicates with a nozzle 15. The cylinder 14 also communicates with an ink supply channel 16. The piston 12 and the piezoelectric element 13 are inserted into the cylinder 14 for movement in the axial direction. The piston 12 and the piezoelectric element 13 are fixed in alignment with each other. A plurality of heads each having the above-described arrangement are disposed in opposition to the surface of a recording sheet.

The operation of the piston-type head will be explained below. When a voltage which is beforehand applied across the electrodes 17*a* and 17*b* is removed, the piezoelectric element 13 expands in the lateral direction indicated by arrows 19 shown parallel to the electrodes 17*a* and 17*b*. The piston 12 is axially moved by the expansion of the piezoelectric element 13 to apply pressure to the ink in the cylinder 14, thereby expelling a jet of ink droplets from the nozzle 15. Each of the heads is made to independently perform the above-described operation, thereby enabling information to be recorded.

In order to improve printing speed, it is desirable that the pitch of nozzles be made as narrow as possible so that a multiplicity of nozzles can be mounted. However, to reduce the nozzle pitch of the bimorph-type head shown in FIG. 1, if the dimension of the piezoelectric element 3 is reduced in the direction perpendicular to the surface of the sheet of FIG. 1, the amount of displacement of the piezoelectric element 3 is also reduced. If this amount of displacement is excessively reduced, it will be impossible to reliably expel a jet of ink droplets. In order to increase the amount of displacement of the piezoelectric element 3 whose dimension is reduced in the above-described manner, it may be applied a high voltage across the piezoelectric element 3. However, this method is accompanied by an increase in the cost of parts of the driving circuit.

In order to reduce the nozzle pitch of the piston-type head shown in FIG. 2, if the dimension of the piezoelectric element 13 is reduced in the direction perpendicular to the surface of the sheet of FIG. 2, the piezoelectric element 13 will be buckled due to the reduced rigidity thereof. As a result, it will be impossible to reliably expel a jet of ink droplets.

For the above-described reasons, a minimum of about 1 mm is required as the nozzle pitch of either type of head.

SUMMARY OF THE INVENTION

It is therefore an object of the present invention to provide a head for an ink-jet printer which can enhance the mounting density of nozzles.

To achieve the above objects, according to the present invention, there is provided a head for an ink-jet printer including an elastic plate, a wall member defining an ink chamber together with the elastic plate, a nozzle provided in the wall member and communicated with the chamber, and a piezoelectric element. The piezoelectric element is shaped in a plate, has a side face, which defines a thickness of the piezoelectric element, and is disposed such that the side face faces the elastic plate. The piezoelectric element presses the elastic plate at the side face by an expansion due to a piezoelectric effect in a direction toward the side face. The head further includes electrodes attached to the piezoelectric element for applying an electric voltage across the piezoelectric element so as to cause the piezoelectric effect.

In the head of the present invention, the piezoelectric element presses the elastic plate at the side face when an electric voltage is applied to the piezoelectric element by use of the electrode. Then, the pressed elastic plate is deflected and applies a pressure to the ink in the ink chamber, thus producing a jet of ink droplets from the nozzle. The piezoelectric element shaped in a plate can be reduced in its thickness without reducing the amount of displacement, i.e. expansion of the piezoelectric element due to the piezoelectric effect in a direction toward the side face. Accordingly, the mounting density of the nozzle in the head can be increased by reducing the thickness of the piezoelectric element.

The above and other objects, features and advantages of the present invention will be apparent from the following description of preferred embodiments of the invention with reference to the accompanying drawings.

DESCRIPTION OF THE PREFERRED EMBODIMENTS

Preferred embodiments of the present invention will be described below with reference to the accompanying drawings.

Figure 1:
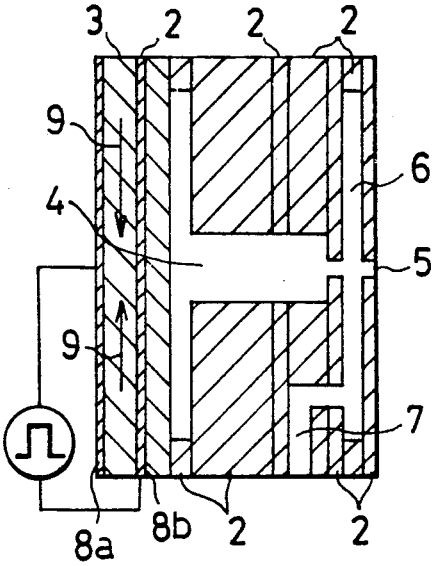
Fig. 1 PRIOR ART
FIG. 1 is a schematic cross-sectional view showing the structure bimorph-type head for an ink-jet printer.
Figure 2:
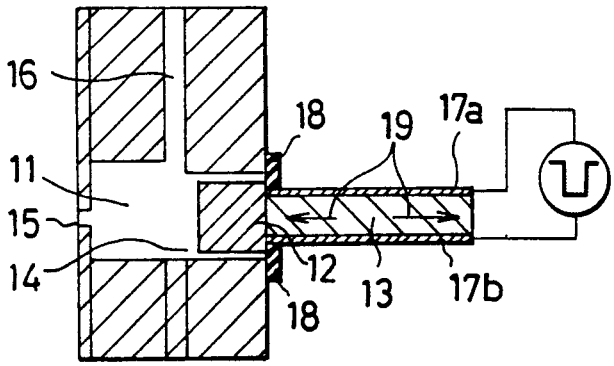
Fig. 2 PRIOR ART
FIG. 2 is a schematic cross-sectional view showing the structure of a piston-type head for an ink-jet printer.
Figure 3:
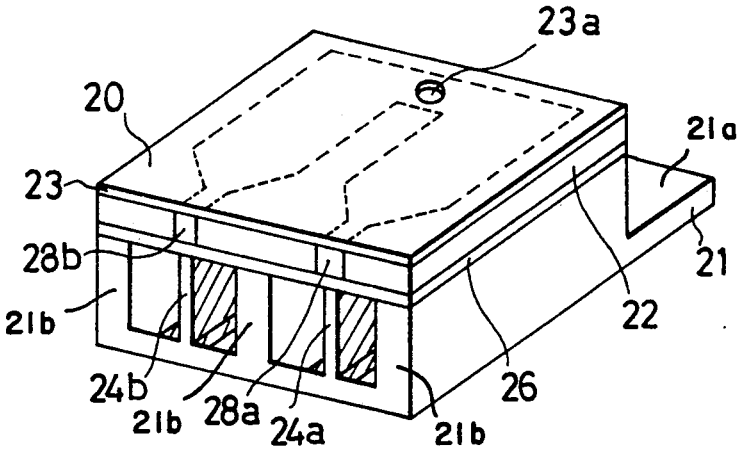
FIG. 3 is a schematic cross-sectional view showing one embodiment the present invention.
Figure 4:
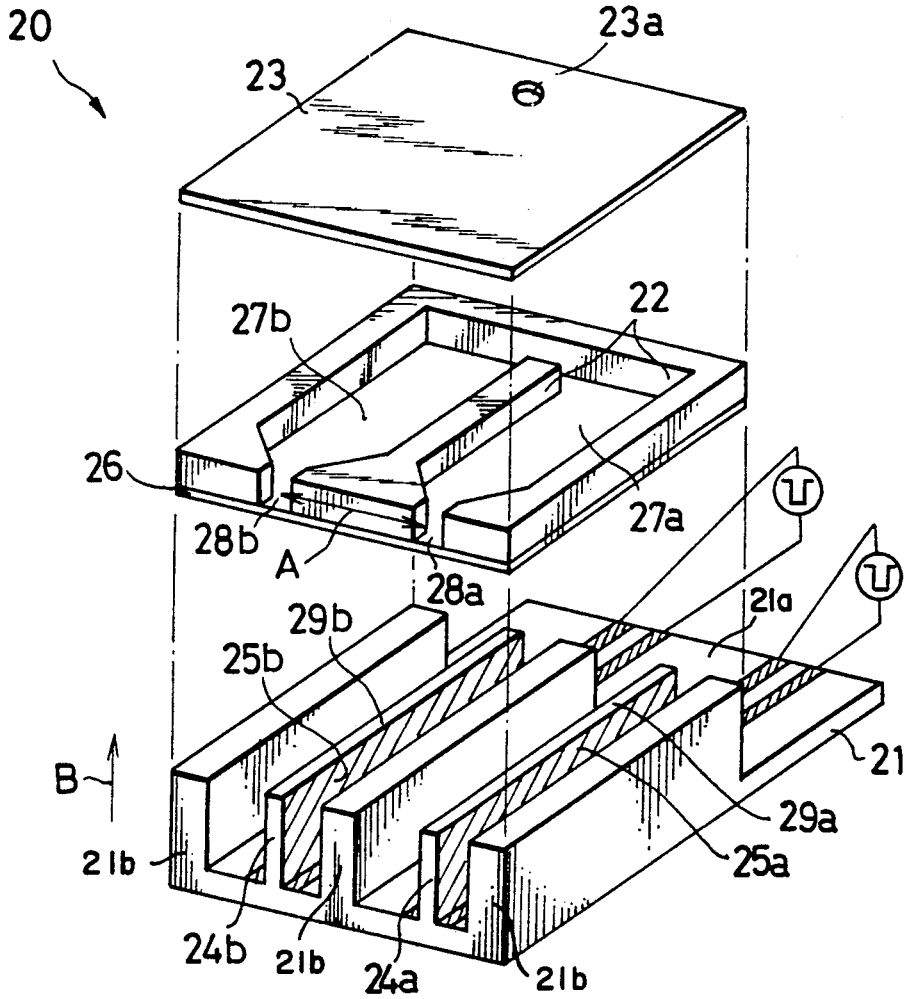
FIG. 4 is a schematic perspective view showing the embodiment of FIG. 3 in exploded form.

FIG. 3 is a schematic cross-sectional view showing one embodiment of a head for an ink-jet printer according to the present invention. FIG. 4 is a schematic perspective view showing the embodiment of FIG. 3 in exploded form.

Referring to FIG. 3 and 4, a head 20 for an ink-jet printer has a base block 21, an ink chamber wall 22 and a cover plate 23.

The base block 21 is made of, for example, lead titanate zirconate. As seen from FIGS. 3 and 4, the base block 21 includes a base plate portion 21*a* and frame member portions 21*b* each shaped in a Piezoelectric elements 24*a* and 24*b* are formed on the base block 21. Each of the piezoelectric elements 24*a*, 24*b* is shaped in a plate. The frame member portions 21*b* are arranged alternatively with and parallel to the piezoelectric elements 24*a*, 24*b*. In FIG. 4, the piezoelectric element 24*a* is provided with a pair of electrodes 25*a* which are disposed on both planes of the piezoelectric element 24*a*.

The piezoelectric element 24*b* is provided with a pair of electrodes 25*b* which are disposed on both planes of the piezoelectric element 24*b*.

Each of the piezoelectric elements 24*a* and 24*b* serves a peizoelectric lateral effect; that is to say, depending on a voltage applied across the electrodes 25*a*, the piezoelectric element 24*a* selectively expands and contracts in the direction indicated by an arrow B in FIG. 4 which is perpendicular to the electric field impressed by the electrodes 25*a*. In the same manner, the piezoelectric element 24*b* expands and contracts by use of the electrodes 25*b*.

The piezoelectric element 24*a* and 24*b* each have a depth of 8 mm, a thickness of 0.1 mm and a height of 0.5 mm. The base block 21 and the piezoelectric elements 24*a* and 24*b* are integrally formed by recessing a single plate of lead titanate zirconate. Namely, the base plate portion 21*a* and the frame member portions 21*b*of the base plate 21, and the piezoelectric elements 24*a*, 24*b*, are all formed from one body of piezoelectric element preformed by recessing as described later below in detail.

The ink chamber wall 22 is mounted on an elastic oscillation plate 26. The oscillation plate 26 is made of, for example, stainless steel glass or the like, while the ink chamber wall 22 is made of, for example, glass, resin or the like. The ink chamber wall 22 defined ink chambers 27*a* and 27*b*, and nozzles 28*a* and 28*b* are formed to communicate with the ink chambers 27*a* and 27*b*, respectively. The oscillation plate 26 is fixed to upper side faces 29*a* and 29*b* of the respective piezoelectric elements 24*a* and 24*b*. Each of the side faces 29*a* and 29*b* defines the thickness of each of the piezoelectric elements 24*a* and 24*b* shaped in a plate.

The cover plate 23 is provided with an ink supply opening 23*a*, and is made of, for example, glass. In the illustrated embodiment, the pitch of the nozzles 28*a* and 28*b*, which is indicated by a double-headed arrow A in FIG. 4, is selected to be 0.5 mm.

The operation of the head 20 will now be explained with reference to FIG. 4. When a voltage which is beforehand applied across the electrodes 25*a* is removed, the piezoelectric element 24*a* expands due to its piezoelectric lateral effect in the direction indicated by the arrow B. Thus, the side face 29*a* presses the oscillation plate 26 to expel a jet of ink droplets from the nozzle 28*a*. Since the piezoelectric element 24*a* has a configuration which extends in the depth-wise direction, it is possible to easily cause enough change in the volume of the ink chamber 27*a*.

The thickness of the piezoelectric-element 24*a*, i.e., the width of the side face 29*a* can be reduced without reducing the amount of displacement of the piezoelectric element 24*a* in the direction indicated by the arrow B.

The piezoelectric element 24*b* is operated, in the same manner as the piezoelectric element 24*a*, by use of the pair of electrodes 25*b*.

Figure 5:
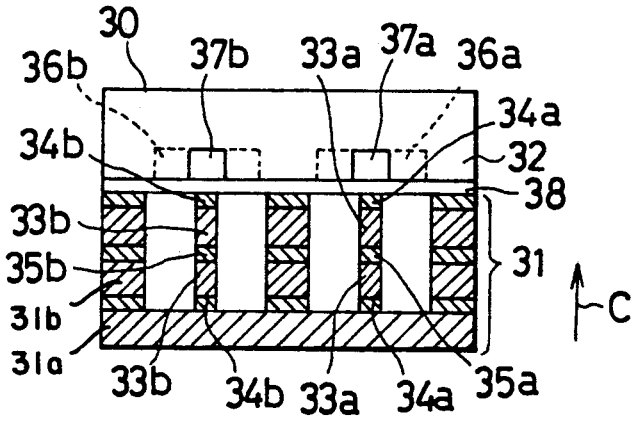
FIG. 5 is a schematic front elevational view showing another embodiment of the present invention.

Another embodiment of a head for an ink-jet printer according to the present invention will be explained below. FIG. 5 is a schematic front elevational view showing a head 30 for an ink-jet printer according to the embodiment which will be described below.

In FIG. 5, the head 30 is provided with a base block 31 and a cover block 32.

The base block 31, i.e., the base plate portion 31*a* as well as the frame member portions 31*b*. are made of, for example, lead titanate zirconate. Piezoelectric elements 33*a* and 33*b* are formed on the base block 31. Each of the piezoelectric elements 33*a*, 33*b* is shaped in a plate. The piezoelectric element 33*a* is sandwiched between a pair of grounding electrodes 34*a* made of nickel. The grounding electrodes 34*a* are grounded. A signal electrode 35*a* made of nickel is interposed in the piezoelectric element 33*a*. Similarly, the piezoelectric element 33*b* is sandwiched between a pair of grounding electrodes 34*b*, and a signal electrode 35*b* made of nickel is interposed in the piezoelectric element 33*b*.

Each of the piezoelectric elements 33*a* and 33*b* serves a piezoelectric vertical effect; that is to say, depending on a voltage applied to the electrode 35*a*, the piezoelectric element 33*a* selectively expands and contracts in the direction indicated by an arrow C which is parallel to the electric field impressed by the electrode 35*a* and 34*a*.

In the same manner, the piezoelectric element 33*b* expands and contracts by use of the electrode 35*b* and 34*b*.

A method of producing the base block 31 will now be explained below.

A first green sheet of 200 μm thickness containing lead titanate zirconate is prepared, and nickel for forming a grounding electrode is deposited on the first green sheet by sputtering. A second green sheet containing lead titanate zirconate is placed on this deposited nickel layer. Then, nickel for forming a signal electrode is deposited on the second green sheet by sputtering. A third green sheet containing lead titanate zirconate is placed on this deposited nickel layer. Further, nickel for forming a grounding electrode is deposited on the third green sheet by sputtering. The product thus obtained is sintered and formed into the piezoelectric element 33*a* or 33*b* by dicing technique.

The cover block 32 is made of photosensitive glass. The cover block 32 is provided with ink chambers 36*a* and 36*b* formed by etching technique. The ink chambers 36*a* and 36*b* are formed to communicate with corresponding nozzles 37*a* and 37*b*. The ink chambers 36*a* and 36*b* are hermetically closed by an oscillation plate 38 made of glass.

The base-block 31 and the oscillation plate 38 are attached by an epoxy adhesive, i.e., the upper face of the frame member portions 31*b* are attached to the lower face of the oscillating plate 38 as seen from FIG. 5, while the cover block 32 and the oscillation plate 38 are attached by an ultraviolet-curing resin adhesive.

Next, the operation of the head 30 will be explained below. When a voltage is applied to the signal electrode 35*a*, the piezoelectric element 33*a* expands in the direction indicated by the arrow C. Thus, the upper side face (not shown) of the piezoelectric element 33*a*, which defines the thickness of the piezoelectric element 33*a* and to which the upper ground electrode 34*a* is attached, apply pressure to the oscillation plate 38 via the upper ground electrode 34*a*, thereby expelling a jet of ink droplets from the nozzle 37*a*.

As is apparent from the foregoing, according to either of the disclosed embodiments, the side face of a piezoelectric element which defines the thickness thereof is used to apply pressure to an oscillation plate. The side face which defines the thickness of the piezoelectric element can be made thin without reducing the amount of displacement of the piezoelectric element which is created by piezoelectric lateral and/or vertical effects. Accordingly, in the head of either of the above embodiments, the nozzle can be mounted at high density and the use of such a head therefore enables high-speed printers to be realized.

In each of the above-described embodiments, there are two sets of nozzles and corresponding piezoelectric elements provided in one head. However, more than two sets of nozzles and piezoelectric elements can be provided in one head in the same manner as the above-described embodiments.

Many widely different embodiments of the present invention may be constructed without departing from the spirit and scope of the present invention. It should be understood that the present invention is not limited to the specific embodiments described in this specification, except as defined in the appended claims.

What is claimed is:

1. A head for ink-jet printer comprising:

an elastic plate;

a plurality of walls defining a plurality of ink chambers together with said elastic plate;

a plurality of nozzles, each being provided in one of said walls and each of said nozzles being in communication with one of said chambers;

a base block including a base plate portion which is disposed parallel to said elastic plate at an opposite side of said walls, and a plurality of frame member portions each shaped in a plate, each of which is disposed perpendicular to said elastic plate and connected to said base plate portion at one end thereof and attached to said elastic plate at another end thereof at a position of said elastic plate corresponding to a boundary of said chambers;

a plurality of piezoelectric elements, each shaped in a plate, having a side face, which defines a thickness of said piezoelectric elements, and disposed such that opposes said elastic plate at each of said chambers for pressing said elastic plate at said side faces by an expansion due to a piezoelectric effect in a direction toward said side faces, said peizoelectric elements and said frame member portions being arranged alternatively on said base plate portion and in parallel to each other; and electrode means attached to each of said piezoelectric elements for applying an electric voltage across each of said piezoelectric elements so as to cause said piezoelectric effect.

2. A head according to claim 1, wherein each of said piezoelectric elements comprises lead titanate zirconate.

3. A head according to claim 1, wherein siad piezoelectric elements and said base block are integrally formed.

4. A head according to claim 1, wherein said elastic plate is made of material selected from the group consisting of stainless steel and glass.

5. A head according to claim 1, further comprising driving means connected to said electrode means for driving siad piezoelectric elements by supplying an electric pulse to said electrode means.

6. A head according to claim 1, wherein each of said electrode means comprises a pair of electrodes disposed on both planes of each of said piezoelectric elements, said peizoelectric elements pressing said elastic plate by an expansion due to a piezoelectric lateral effect.

7. A head according to claim 1, wherein each said electrode means comprises a signal electrode interposed in each of said peizoelectric elements in parallel to said side face, and a pair of ground electrodes, one of which is disposed on said side face and the other of which is disposed on a face opposite to each siad side face of said peizoelectric elements, said piezoelectric elements pressing said elastic plate by an expansion due to a piezoelectric vertical effect.

8. A head according to claim 7, wherein each of said peizoelectric elements comprises layered green sheets containing lead titanate zirconate, said signal electrode comprising a nickel layer interposed between said green sheets.

9. A head according to claim 1, wherein said base block is attached to said elastic plate at said frame member portions by an epoxy adhesive.

10. A head according to claim 3, wherein said piezoelectric element and said frame member portion adjacent to each other are spaced from each other by a predetermined distance by a recess formed therebetween.

* * * * *